US006116140A

United States Patent [19]

Barthalow et al.

[11] Patent Number: 6,116,140

[45] Date of Patent: Sep. 12, 2000

[54] TELESCOPING SYSTEM WITH MULTI-STAGE TELESCOPIC CYLINDER

[75] Inventors: Henry D. Barthalow, Greencastle; Claude R. Zimmerman, Mercersburg, both of Pa.

[73] Assignee: Grove U.S. L.L.C., Shady Grove, Pa.

[21] Appl. No.: 09/055,239

[22] Filed: Apr. 6, 1998

[51] Int. Cl.[7] ..... F15B 11/18

[52] U.S. Cl. ..... 91/167 R; 91/530; 91/173

[58] Field of Search ..... 91/167 R, 173, 91/176, 530; 92/66, 51, 52, 53

[56] References Cited

U.S. PATENT DOCUMENTS

| | | | |
|---|---|---|---|
| 2,517,153 | 8/1950 | Wood . | |
| 3,128,674 | 4/1964 | Ganchar et al. . | |
| 3,373,572 | 3/1968 | Kemper . | |
| 3,483,798 | 12/1969 | Parrett et al. . | |
| 3,603,207 | 9/1971 | Parrett | 91/167 R |
| 3,610,100 | 10/1971 | Hoffman | 91/167 R |
| 3,696,712 | 10/1972 | Sung . | |
| 3,920,084 | 11/1975 | Russell, Jr. | 92/53 X |
| 3,942,415 | 3/1976 | Haller | 92/118 |
| 3,970,171 | 7/1976 | Honecker et al. | 92/53 X |
| 4,125,974 | 11/1978 | Kay et al. | 91/530 X |
| 4,523,512 | 6/1985 | Hessel et al. | 92/53 X |
| 4,691,617 | 9/1987 | Purkott . | |
| 4,726,281 | 2/1988 | De Filippi | 91/167 R |
| 4,733,598 | 3/1988 | Innes et al. . | |
| 4,741,246 | 5/1988 | Padarev | 91/167 R |
| 4,759,257 | 7/1988 | Hund, Jr. | 92/53 X |
| 4,791,854 | 12/1988 | Banicevic . | |
| 5,111,733 | 5/1992 | Baraniak | 91/167 R |
| 5,247,872 | 9/1993 | Hoshi . | |
| 5,263,402 | 11/1993 | Gottlieb . | |
| 5,305,605 | 4/1994 | Cella . | |
| 5,322,004 | 6/1994 | Sims | 91/167 R |
| 5,341,725 | 8/1994 | Dick . | |
| 5,375,348 | 12/1994 | Kishi . | |
| 5,377,432 | 1/1995 | Kishi . | |

FOREIGN PATENT DOCUMENTS

| | | |
|---|---|---|
| 0446115A1 | 9/1991 | European Pat. Off. . |
| 69102455T2 | 11/1994 | Germany . |

*Primary Examiner*—John E. Ryznic

[57] ABSTRACT

The telescoping system includes a first and second fluid motor. The first fluid motor includes a first cylinder and a second cylinder nested in the first cylinder. The second fluid motor includes the second cylinder and a piston disposed in the second cylinder. The second cylinder has a double barrel outer wall forming a hydraulic fluid passageway. A hydraulic control system in the telescoping system includes a single control valve, solenoid valves, and holding valves, and controls extension and retraction of the telescoping system.

13 Claims, 1 Drawing Sheet

TELESCOPING SYSTEM WITH MULTI-STAGE TELESCOPIC CYLINDER

BACKGROUND OF THE INVENTION

1. Field of the Invention

The present invention relates to a telescoping system for selectively extending and retracting telescopic sections of a multi-section telescoping structure; and more particularly, to a telescoping system with a multi-stage telescopic cylinder.

2. Description of Related Art

Many prior art telescoping systems include multiple single stage telescopic cylinders or a single multi-stage telescopic cylinder for extending and retracting multi-section telescopic structures such as multi-section booms. A multi-stage telescopic cylinder includes a plurality of cylinders and pistons arranged in a telescopic manner one within the other. Seals between respective pistons and cylinders, and internal passageways, permit hydraulic fluid to flow for either extending or retracting the cylinders. Each cylinder is typically connected to a section in the multi-section telescoping structure to telescope that section. Also, the inner most or smallest rod, forming a portion of the inner most or smallest piston, is connected to the base section of the multi-section telescoping structure.

Typically, these multi-stage telescoping cylinders require hydraulic connections, for example, at least at the outer most or largest cylinder. As a result, these systems include hose reels which allow extension and retraction of hydraulic fluid carrying hoses attached to the multi-stage telescopic cylinder at the hydraulic connections. U.S. Pat. No. 4,726,281 to De Filippi discloses such a telescoping system. Such systems can also require mounting control valves on the multi-stage telescoping structure near or at those hydraulic connections.

U.S. Pat. Nos. 5,111,733; 3,610,100; 3,603,207; and 3,128,674 disclose telescoping systems which eliminate hydraulic connections along the telescopic cylinder or cylinders. Instead, the hydraulic connections are made at the inner most or smallest rod of the telescopic cylinder. These telescoping systems, however, have complex inner most rod structures and/or have hydraulic control systems including more than one control valve.

SUMMARY OF THE INVENTION

It is an object of the present invention to provide a telescoping system including a multi-stage telescopic cylinder having a simplified inner most rod structure and a reduced number of control valves.

Another object of the present invention is to provide a telescoping system including a multi-stage telescopic cylinder wherein the hydraulic connections to the telescopic cylinder are made at the inner most rod thereof.

A further object of the present invention is to provide a telescoping system having a multi-stage telescopic cylinder wherein the multi-stage telescopic cylinder includes at least a first tele cylinder and a second tele cylinder and the second tele cylinder includes a rod having a double barrel outer cylindrical wall.

A still further object of the present invention is to provide a telescopic system having a two-stage telescopic cylinder and a simple hydraulic control system therefor which includes a single control valve.

These and other objects are achieved by providing a telescoping system, comprising: a multi-stage telescopic cylinder including at least a first tele cylinder and a second tele cylinder, said first tele cylinder including a first rod and a first piston head, and said second tele cylinder including a second rod, second piston head, and a first cylinder; said first piston head disposed in said second rod and connected to a first end of said first rod; said second piston head disposed in said first cylinder and connected to a first end of said second rod; said second rod including an inner cylindrical wall and an outer cylindrical wall, said inner cylindrical wall extending through said first piston head into said first rod, said outer cylindrical wall having an inner barrel and an outer barrel defining a first passageway; said inner barrel, said first rod and said first piston head defining a first chamber, and said inner barrel including a second passageway between said first chamber and said first passageway; said outer barrel, said second piston head and said first cylinder defining a second chamber, said outer barrel including a third passageway between said first passageway and said second chamber; and said first rod and said first piston head defining a fourth passageway communicating with said first chamber.

These and other objects are also achieved by providing a telescoping system, comprising: a multi-stage telescopic cylinder including at least a first tele cylinder and a second tele cylinder, said first tele cylinder including a first rod and a first piston head, and said second tele cylinder including a second rod, second piston head, and a first cylinder; said first rod having a first and second end and defining first, second and third passageways, said first end having a first port communicating with said first passageway, a second port communicating with said second passageway and a third port communicating with said third passageway; said first piston head connected to said second end of said first rod, said first piston head defining a fourth passageway communicating with said first passageway, a fifth passageway communicating with said second passageway and a sixth passageway communicating with said third passageway; said second rod having an inner cylindrical wall and an outer cylindrical wall, said inner cylindrical wall extending into said fifth and third passageways, said outer cylindrical wall having an inner and outer barrel defining a seventh passageway, said first piston head disposed and sliding in said inner barrel such that said first rod and said inner barrel define a first chamber, said first chamber communicating with said sixth passageway, said inner barrel having an eighth passageway communicating with said first chamber and said seventh passageway, said outer barrel having a ninth passageway communicating with said seventh passageway; said second piston head disposed at one end of said second rod and defining a tenth passageway which communicates with said third passageway via said inner cylindrical wall, said first and second piston head, said inner cylindrical wall and said inner barrel defining a second chamber which communicates with said fourth passageway, said second piston head disposed within said first cylinder such that said first cylinder and said outer barrel define a third chamber and said second piston head and said first cylinder define a fourth chamber, said third chamber communicating with said ninth passageway, and said fourth chamber communicating with said tenth passageway.

These and other objects are further achieved by providing a telescoping system, comprising: a multi-stage telescopic cylinder including at least a first tele cylinder and a second tele cylinder, said first tele cylinder including a first rod and a first piston head, and said second tele cylinder including a second rod, a second piston head, and a first cylinder; said first piston head disposed in said second rod and connected to a first end of said first rod; said second piston head disposed in said first cylinder and connected to a first end of said second rod; said second rod including an inner cylindrical wall and an outer cylindrical wall, said inner cylindrical wall extending through said first piston head into said first rod; said first rod, said first piston head and said second rod defining a first chamber; said first piston head, said second rod and said second piston head defining a second chamber; said second rod, said second piston head and said first cylinder defining a third chamber; said second piston head and said first cylinder defining a fourth chamber; a second end of said first rod, opposite said first end of said first rod, including a first port communicating with said second chamber, a second port communicating with said fourth chamber, and a third port communicating with said first and third chambers; a first holding valve connected to said first port and having a first bias input, said first holding valve allowing hydraulic fluid to freely enter said first port, and allowing hydraulic fluid to exit said first port when hydraulic fluid is received at said first bias input; a second holding valve connected to said second port and having a second bias input, said second holding valve allowing hydraulic fluid to freely enter said second port, and allowing hydraulic fluid to exit said second port when hydraulic fluid is received at said second bias input; a first solenoid valve selectively supplying hydraulic fluid to said first holding valve; a second solenoid valve selectively supplying hydraulic fluid to said second holding valve; a first line connected to said third port and said first and second bias input; and a control valve selectively supplying hydraulic fluid to and exhausting hydraulic fluid from said first line, said first solenoid valve, and said second solenoid valve.

These and other objects are still further achieved by providing a telescoping system, comprising: a first fluid motor including a first cylinder and a second cylinder nested in said first cylinder, said second cylinder having a double barrel outer wall forming a hydraulic fluid passageway of said first fluid motor; and a second fluid motor including said second cylinder and a piston disposed in said second cylinder.

These and other objects are additionally achieved by providing a telescoping system, comprising: a first fluid motor including a first cylinder and a second cylinder nested in said first cylinder, said first fluid motor including a first extension chamber and a first retraction chamber, said first cylinder extending with respect to said second cylinder when said first extension chamber increases in volume, and said first cylinder retracting with respect to said second cylinder when said first retraction chamber increases in volume; a second fluid motor including said second cylinder and a piston disposed in said second cylinder, said second fluid motor including a second extension chamber and a second retraction chamber, said second cylinder extending with respect to said piston when said second extension chamber increases in volume, and said second cylinder retracting with respect to said piston when said second retraction chamber increases in volume; a first holding valve communicating with said second extension chamber and having a first bias input, said first holding valve allowing hydraulic fluid to freely enter said first extension chamber, and allowing hydraulic fluid to exit said first extension chamber when hydraulic fluid is received at said first bias input; a second holding valve communicating with said first extension chamber and having a second bias input, said second holding valve allowing hydraulic fluid to freely enter said first extension chamber, and allowing hydraulic fluid to exit said first extension chamber when hydraulic fluid is received at said second bias input; a first solenoid valve selectively supplying hydraulic fluid to said first holding valve; a second solenoid valve selectively supplying hydraulic fluid to said second holding valve; a first line communicating with said first and second retraction chambers and said first and second bias inputs; and a control valve selectively supplying hydraulic fluid to and exhausting hydraulic fluid from said first line, said first solenoid valve, and said second solenoid valve.

Other objects, features, and characteristics of the present invention; methods, operation, and functions of the related elements of the structure; combination of parts; and economies of manufacture will become apparent from the following detailed description of the preferred embodiments and accompanying drawings, all of which form a part of this specification, wherein like reference numerals designate corresponding parts in the various figures.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE PREFERRED EMBODIMENTS

Figure 1:
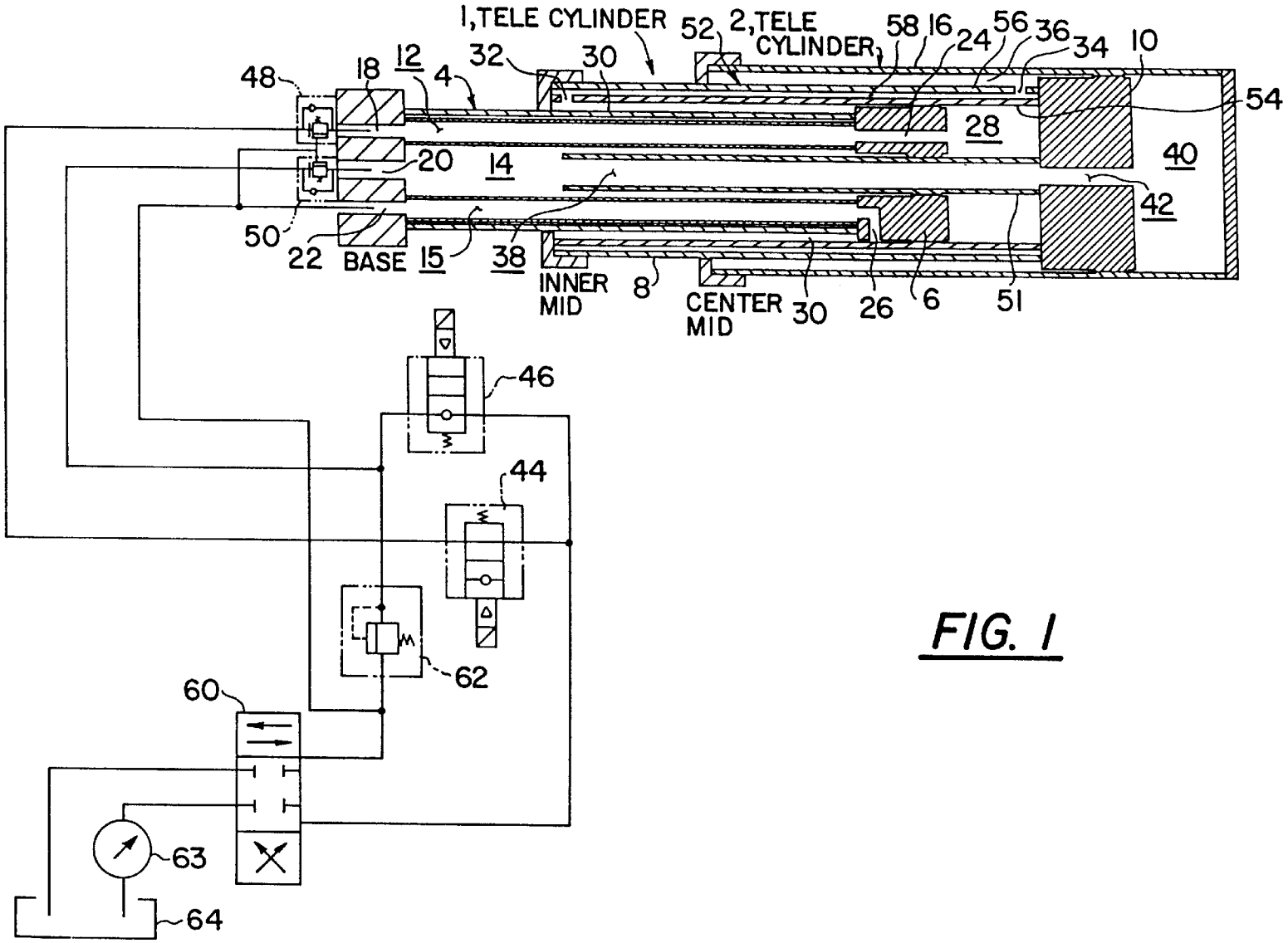
FIG. 1 illustrates the longitudinal cross-section of a telescoping system according to the present invention which includes a two-stage telescopic cylinder.

FIG. 1 illustrates the longitudinal cross-section of a telescoping system according to the present invention which includes a two-stage telescopic cylinder. As shown, the two stage telescopic cylinder includes a first tele cylinder 1 and a second tele cylinder 2. The first tele cylinder 1 includes a cylindrical first rod 4 connected to an annular first piston head 6. The first piston head 6 is disposed within a cylindrical second rod 8 of the second tele cylinder 2. The second rod 8 serves as the cylinder for the first tele cylinder 1. An annular second piston head 10 is connected to the second rod 8, and is disposed within a cylinder 16.

Preferably, one end of the first rod 4 is mounted to the base section of a multi-section telescoping structure. A multi-section telescoping boom will be described as the multi-section telescoping structure for purposes of discussion. The multi-section telescoping boom can be a 3, 4, or 5 section boom. FIG. 1 illustrates the connections between the telescopic cylinder of the present invention and a five section boom. Specifically, the first rod 4 is connected to the base section, the second rod 8 is connected to the inner mid section, and the cylinder 16 is connected to the center mid section.

The first rod 4 has a first port 18, a second port 20, and a common port 22 formed in an end thereof. The first rod 4 contains a first passageway 12 communicating with the first port 18, a second passageway 14 communicating with the second port 20, and a third passageway 15 communicating with the common port 22. The first piston head 6 includes a fourth passageway 24 formed therein such that hydraulic fluid entering the first rod 4 via the first port 18 and flowing through the first passageway 12 communicates with a first chamber 28. As shown in FIG. 1, the first chamber 28 is defined by the second rod 8, the first piston head 6 and the second piston head 10.

The first piston head 6 also includes a fifth passageway 26 which allows fluid communication between the third passageway 15 and a second chamber 30. The second chamber 30 is defined by the first rod 4, the second piston head 6, and the second rod 8.

As shown in FIG. 1, the second rod 8 includes a cylindrical inner wall 51 and a cylindrical outer wall 52. The cylindrical outer wall 52 has an inner barrel 54 and an outer barrel 56 which form a sixth passageway 58. The inner barrel 54 includes a seventh passageway 32 formed therein which allows fluid communication between the second chamber 30 and the sixth passageway 58. The outer barrel 56 includes an eighth passageway 34 formed therein which allows fluid communication between the seventh passageway 32 and a third chamber 36. As shown, the third chamber 36 is defined by the outer barrel 56, the second piston head 10, and the cylinder 16.

As shown in FIG. 1, the cylindrical inner wall 51 extends through the first piston head 6 and into the first rod 4 to form a ninth passageway 38. The ninth passageway 38 allows fluid communication between the second passageway 14 and a tenth passageway 42 formed in the second piston head 10. Accordingly, the second, the ninth and the tenth passageways 14, 38 and 42 allow fluid communication between the second port 20 and a fourth chamber 40. As shown, the fourth chamber 40 is defined by the second piston head 10 and the cylinder 16.

As shown in FIG. 1, the telescoping system further includes first and second holding valves 48 and 50 disposed at the first and second ports 18 and 20, respectively. The first holding valve 48 allows hydraulic fluid to freely flow into the first port 18, but only allows hydraulic fluid to flow out of the first port 18 when hydraulic fluid is received at its bias input. Similarly, the second holding valve 50 allows hydraulic fluid to freely flow into the second port 20, but only allows hydraulic fluid to flow out of the second port 20 when hydraulic fluid is received at its bias input. A first solenoid valve 44 regulates the supply of hydraulic fluid to the first holding valve 48, and is open in a de-energized state. A second solenoid valve 46 controls the supply of hydraulic fluid to the second holding valve 50, and is closed in a de-energized state. Both the first and second solenoid valves 44 and 46 are connected to a first control port of a control valve 60. A second control port of the control valve 60 is connected to the common port 22 and the bias inputs of the first and second holding valves 48 and 50.

The control valve 60 is a tri-state control valve. In a first state, the hydraulic fluid supplied to the control valve 60 by a pump 63 is output from the first control port (i.e., to the first and second solenoid valves 44 and 46), while the hydraulic fluid at the second control port is exhausted to a reservoir 64. In a second state, no hydraulic fluid is supplied to or exhausted from either the first or second control ports. In the third state, the hydraulic fluid from the pump 63 is supplied to the second port (i.e., the common port 22 and the bias inputs of the first and second holding valves 48 and 50), while the hydraulic fluid at the first control port is exhausted to the reservoir 64.

As further shown in FIG. 1, a relief valve 62 connects a line leading from the second solenoid valve 46 to the second holding valve 50 with the line leading from the control valve 60 to the common port 22.

The operation of the telescoping system shown in FIG. 1 will now be described. The telescopic cylinder according to the present invention has two modes of operation: sequenced and synchronized. Sequenced operation will be discussed first. Assuming that the telescopic cylinder illustrated in FIG. 1 is fully retracted, the first and second solenoid valves 44, 46 are de-energized, and the control valve 60 is placed in the first state. In the de-energized state, the first solenoid valve 44 is open and the second solenoid valve 46 is closed. Consequently, hydraulic fluid flows via the first solenoid valve 44 through the first holding valve 48 into the first port 18. The hydraulic fluid supplied to the first port 18 flows via the first passageway 12 and the fourth passageway 24 into the first chamber 28, and exerts a force on the second piston head 10. As a result, the second rod 8 and the cylinder 16 will extend.

Once fully stroked the first solenoid valve 44 and the second solenoid valve 46 are energized. The fully stroked position can be detected by, for example, a proximity switch (not shown). Energizing the first and second solenoid valves 44 and 46 causes the first solenoid valve 44 to close and the second solenoid valve 46 to open. Hydraulic fluid then flows through the second solenoid valve 46 and the second holding valve 50, and enters the second port 20. The hydraulic fluid flowing into the second port 20 enters the fourth chamber 40 via the second, ninth, and tenth passageways 14, 38, and 42. This hydraulic fluid exerts pressure on the cylinder 16 causing the cylinder 16 to extend. Once fully stroked, the second solenoid valve 46 is de-energized. Again, the fully stroked position can be detected using a proximity switch (not shown).

To retract the telescopic cylinder illustrated in FIG. 1, the second solenoid valve 46 is opened and the control valve 60 is placed in the third state. Hydraulic pressure is thus supplied to the common port 22 and the bias inputs of the first and second holding valves 48 and 50. The supply of hydraulic fluid pilots the first and second holding valves 48, 50 open to allow hydraulic fluid to flow out of the first and second ports 18, 20. The hydraulic fluid supplied to the common port 22 flows into the second chamber 30 via the third and fourth passageways 15 and 26. The force exerted upon the second rod 8 by the hydraulic fluid, however, does not cause the second rod 8 to retract since the first solenoid valve 44 is maintained in the closed state. Instead, the hydraulic fluid flows into the third chamber 36 via the seventh, sixth, and eighth passageways 32, 58, and 34. The hydraulic fluid pressure then exerts a force on the cylinder 16 causing the cylinder 16 to retract because the second solenoid valve 46 is open.

Once the second cylinder 16 has fully retracted, the second solenoid valve 46 is closed and the first solenoid valve 44 is opened. In this state, hydraulic fluid is allowed to flow through the first solenoid valve 44, such that the force exerted on the second rod 8 by the hydraulic fluid causes the second rod 8 to retract.

In the synchronized mode of operation, the first and second solenoid valves 44 and 46 are switched between the open and closed states at predetermined positional settings to extend the second piston head 10 and the cylinder 16 in a synchronized manner. Likewise, once the hydraulic fluid has been supplied to the common port 22, the first and second solenoid valves 44 and 46 are also switched between the open and closed state in order to retract the second rod 8 and the cylinder 16 in a synchronized manner.

In the telescoping system according to the present invention, all the hydraulic connections to the telescopic cylinder are made at the end of the first rod 4, which is mounted to the base section of the multi-section boom. Consequently, all the hydraulic connections to the telescopic cylinder are made at the base section of the boom.

Accordingly, the telescoping system according to the present invention eliminates the need for hose reels and associated hoses.

Because hydraulic fluid connections are not made along the length of the telescopic cylinder, the telescoping system according to the present invention does not require mounting valves on the boom sections near or at those connections. Instead, the solenoid valves 44 and 46 can be mounted to the turntable supporting the multi-section boom.

Furthermore, by using a double barreled outer wall for the second rod, the structure of the inner most rod is greatly simplified. By structuring the hydraulic control system using holding valves and solenoid valves, only a single control valve is required to control the operation of the telescopic cylinder according to the present invention.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A telescoping system, comprising:

a multi-stage telescopic cylinder including at least a first tele cylinder and a second tele cylinder, said first tele cylinder including a first rod and a first piston head, and said second tele cylinder including a second rod, second piston head, and a first cylinder;

said first piston head disposed in said second rod and connected to a first end of said first rod;

said second piston head disposed in said first cylinder and connected to a first end of said second rod;

said second rod including an inner cylindrical wall and an outer cylindrical wall, said inner cylindrical wall extending through said first piston head into said first rod, said outer cylindrical wall having an inner barrel and an outer barrel defining a first passageway;

said inner barrel, said first rod and said first piston head defining a first chamber, and said inner barrel including a second passageway between said first chamber and said first passageway;

said outer barrel, said second piston head and said first cylinder defining a second chamber, said outer barrel including a third passageway between said first passageway and said second chamber; and said first rod and said first piston head defining a fourth passageway communicating with said first chamber.

2. The telescoping system according to claim 1, wherein said first rod includes a first port in a second end thereof, said second end is opposite said first end, and said first port communicates with said fourth passageway.

3. The telescoping system according to claim 2, further comprising:

means for supplying hydraulic fluid to said first port to selectively retract at least one of said second rod and said first cylinder.

4. The telescoping system of claim 1, wherein said second passageway is disposed further from said second piston head than said third passageway.

5. A telescoping system, comprising:

a multi-stage telescopic cylinder including at least a first tele cylinder and a second tele cylinder, said first tele cylinder including a first rod and a first piston head, and said second tele cylinder including a second rod, second piston head, and a first cylinder;

said first rod having a first and second end and defining first, second and third passageways, said first end having a first port communicating with said first passageway, a second port communicating with said second passageway and a third port communicating with said third passageway;

said first piston head connected to said second end of said first rod, said first piston head defining a fourth passageway communicating with said first passageway, a fifth passageway communicating with said second passageway and a sixth passageway communicating with said third passageway;

said second rod having an inner cylindrical wall and an outer cylindrical wall, said inner cylindrical wall extending into said fifth and third passageways, said outer cylindrical wall having an inner and outer barrel defining a seventh passageway, said first piston head disposed and sliding in said inner barrel such that said first rod and said inner barrel define a first chamber, said first chamber communicating with said sixth passageway, said inner barrel having an eighth passageway communicating with said first chamber and said seventh passageway, said outer barrel having a ninth passageway communicating with said seventh passageway;

said second piston head disposed at one end of said second rod and defining a tenth passageway which communicates with said third passageway via said inner cylindrical wall, said first and second piston head, said inner cylindrical wall and said inner barrel defining a second chamber which communicates with said fourth passageway, said second piston head disposed within said first cylinder such that said first cylinder and said outer barrel define a third chamber and said second piston head and said first cylinder define a fourth chamber, said third chamber communicating with said ninth passageway, and said fourth chamber communicating with said tenth passageway.

6. The telescoping system of claim 5, wherein said eighth passageway is disposed further from said second piston head than said ninth passageway.

7. The telescoping system of claim 5, further comprising:

supply means for selectively supplying hydraulic fluid to said first, second and third ports.

8. The telescoping system of claim 7, wherein said supply means comprises:

a first holding valve connected to said first port and having a first bias input, said first holding valve allowing hydraulic fluid to freely enter said first port, and allowing hydraulic fluid to exit said first port when hydraulic fluid is received at said first bias input;

a second holding valve connected to said second port and having a second bias input, said second holding valve allowing hydraulic fluid to freely enter said second port, and allowing hydraulic fluid to exit said second port when hydraulic fluid is received at said second bias input;

a first solenoid valve selectively supplying hydraulic fluid to said first holding valve;

a second solenoid valve selectively supplying hydraulic fluid to said second holding valve;

a first line connected to said third port and said first and second bias input; and a control valve selectively supplying hydraulic fluid to and exhausting hydraulic fluid from said first line, said first solenoid valve, and said second solenoid valve.

9. The telescoping system according to claim 8, wherein said control valve includes a first and second control port, said first port connected to said first line and said second port connected to said first and second solenoid valves, and said control valve selectively supplying hydraulic fluid to and exhausting hydraulic fluid from said first and second control ports.

10. A telescoping system, comprising:

a first fluid motor including a first cylinder and a second cylinder nested in said first cylinder, said second cylinder having an inner wall and a cylindrical outer wall, said cylindrical outer wall having an inner barrel and an outer barrel forming a hydraulic fluid passageway of said first fluid motor; and a second fluid motor including said second cylinder and a piston disposed in said second cylinder such that said piston is disposed between said inner wall and said inner barrel.

11. The telescoping system according to claim 10, wherein said first fluid motor includes a first extension chamber and a first retraction chamber, said first cylinder extending with respect to said second cylinder when said first extension chamber increases in volume, and said first cylinder retracting with respect to said second cylinder when said first retraction chamber increases in volume;

said second fluid motor includes a second extension chamber and a second retraction chamber, said second cylinder extending with respect to said piston when said second extension chamber increases in volume, and said second cylinder retracting with respect to said piston when said second retraction chamber increases in volume; and said double barrel of said second cylinder forming a hydraulic fluid passageway between said first and second retraction chambers.

12. The telescoping system of claim 11, further comprising:

a first holding valve communicating with said second extension chamber and having a first bias input, said first holding valve allowing hydraulic fluid to freely enter said first extension chamber, and allowing hydraulic fluid to exit said first extension chamber when hydraulic fluid is received at said first bias input;

a second holding valve communicating with said first extension chamber and having a second bias input, said second holding valve allowing hydraulic fluid to freely enter said first extension chamber, and allowing hydraulic fluid to exit said first extension chamber when hydraulic fluid is received at said second bias input;

a first solenoid valve selectively supplying hydraulic fluid to said first holding valve;

a second solenoid valve selectively supplying hydraulic fluid to said second holding valve;

a first line communicating with said first and second retraction chambers and said first and second bias inputs; and a control valve selectively supplying hydraulic fluid to and exhausting hydraulic fluid from said first line, said first solenoid valve, and said second solenoid valve.

13. The telescoping system according to claim 12, wherein said control valve includes a first and second control port, said first port connected to said first line and said second port connected to said first and second solenoid valves, and said control valve selectively supplying hydraulic fluid to and exhausting hydraulic fluid from said first and second control ports.

* * * * *